US006827065B2

(12) United States Patent
Gottemoller et al.

(10) Patent No.: US 6,827,065 B2
(45) Date of Patent: Dec. 7, 2004

(54) DIESEL INJECTION SYSTEM WITH DUAL FLOW FUEL LINE

(75) Inventors: Paul Gottemoller, Palos Park, IL (US); Michael B. Goetzke, Orland Park, IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/409,485

(22) Filed: Apr. 8, 2003

(65) Prior Publication Data

US 2004/0200457 A1 Oct. 14, 2004

(51) Int. Cl.[7] ..... F02M 55/00

(52) U.S. Cl. ..... 123/456; 123/468; 123/514; 123/198 D

(58) Field of Search ..... 123/514, 456, 123/468, 469, 198 D

(56) References Cited

U.S. PATENT DOCUMENTS

| | | | | | |
|---|---|---|---|---|---|
| 4,149,568 | A | * | 4/1979 | Kuntz et al. | 138/114 |
| 4,926,829 | A | * | 5/1990 | Tuckey | 123/497 |
| 4,955,409 | A | * | 9/1990 | Tokuda et al. | 137/561 A |
| 5,076,242 | A | * | 12/1991 | Parker | 123/514 |
| 5,233,963 | A | | 8/1993 | Gregorius et al. | 123/456 |
| 5,239,964 | A | * | 8/1993 | Diener et al. | 123/456 |
| 5,560,243 | A | | 10/1996 | Wild | 73/118.1 |
| 6,397,826 | B1 | * | 6/2002 | Coleman | 123/541 |
| 6,499,466 | B2 | * | 12/2002 | Lee | 123/456 |
| 6,604,509 | B1 | * | 8/2003 | Hegner | 123/456 |

FOREIGN PATENT DOCUMENTS

| | | |
|---|---|---|
| DE | 19815167 A1 | 10/1999 |
| DE | 10012676 A1 | 9/2001 |
| EP | 1150006 A2 | 10/2001 |

* cited by examiner

*Primary Examiner*—Thomas Moulis
(74) *Attorney, Agent, or Firm*—Cary W. Brooks

(57) ABSTRACT

A double walled fuel line connects diesel fuel injectors in a common rail system. An inner line carries high pressure fuel from a fuel pump to the fuel injectors. Low pressure return fuel flows back through an outer fuel line which acts as a return line. The double walled line reduces the number of separate pipe connections needed in the system and provides protection against loss of high pressure fuel from the system as well as a simplified method for detecting fuel leaks. Monitoring fuel pressure in the low pressure line allows a fuel pressure sensor to detect leaks in the system by comparing fuel pressure in the low pressure line against typical line pressure. Higher than normal pressure in the low pressure line indicates a leak in the high pressure line. Lower than normal pressure indicates a leak in the low pressure return line.

4 Claims, 4 Drawing Sheets

DIESEL INJECTION SYSTEM WITH DUAL FLOW FUEL LINE

TECHNICAL FIELD

This invention relates to fuel injection systems for diesel engines.

BACKGROUND OF THE INVENTION

Typical common rail fuel injection systems have one localized high pressure fuel pump connected by serially connected inlet and outlet lines which carry high pressure fuel between the injectors and the fuel pump. The lines connecting to the fuel pump are single or double walled depending upon the application. Double walled fuel lines are currently used to provide additional leak protection around the inner fuel line. Specifically, the inner line is used to carry pressurized fuel while the outer line is kept dry to form an extra barrier between the inner fuel line and the high temperature surfaces in an engine.

SUMMARY OF THE INVENTION

The present invention provides a common rail diesel fuel injection system. The system uses a double walled fuel line having a high pressure inner fuel tube for delivering high pressure fuel from a fuel pump to a series of fuel injectors, and a low pressure outer fuel tube for returning low pressure fuel from the fuel injectors to the fuel pump or the fuel tank. The outer line surrounds the inner line and prevents leaks in the inner line from escaping into the engine compartment. The double walled fuel line provides an additional barrier of protection between the high pressure inner line and the engine as well as a convenient path for fuel flow both to and from the injectors.

Sensing fuel leaks in the system may be accomplished by monitoring fuel pressure in the low pressure fuel line and comparing it against a map of predetermined normal pressures. If a leak occurs in the outer line, the pressure in the line will drop below normal because of lost fuel. If a leak occurs in the inner line, high pressure fuel will flow into the low pressure outer line, increasing fuel pressure in the outer line. Therefore, an increase or decrease in the normal return fuel pressure in the outer line will indicate that there is a leak and whether it is in the inner or the outer line.

These and other features and advantages of the invention will be more fully understood from the following description of certain specific embodiments of the invention taken together with the accompanying drawings.

DESCRIPTION OF THE PREFERRED EMBODIMENT

Figure 1:
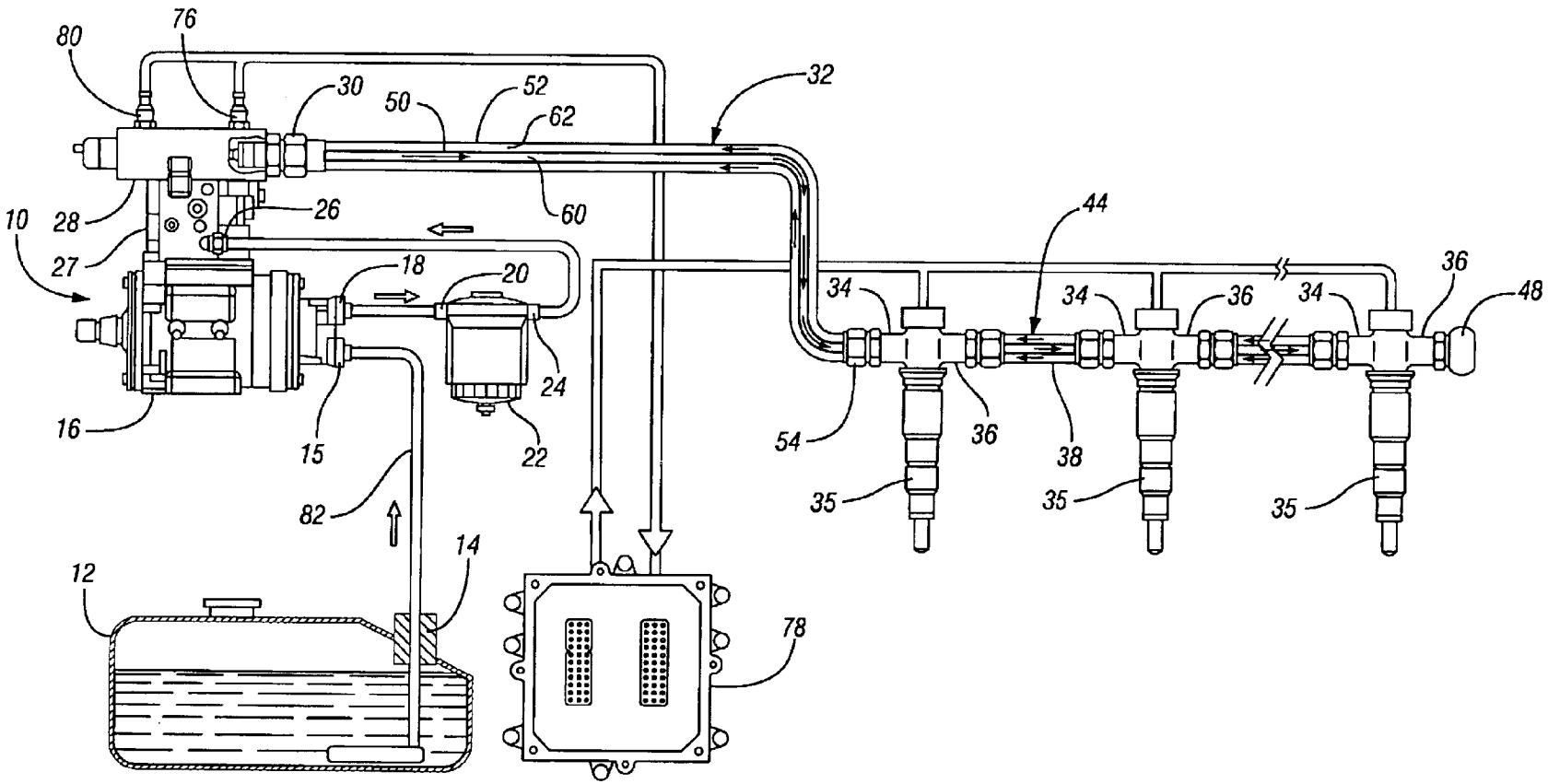
FIG. 1 is a diagrammatic view of a fuel injection system according to the present invention.

Referring to FIG. 1 of the drawings in detail, numeral 10 generally indicates a common rail fuel injection system for a diesel engine. System 10 includes a fuel tank 12 having an outlet 14 connected to a metering valve 15 of a low pressure fuel pump 16. Fuel pump 16 has a metering valve outlet 18 connected to an inlet 20 of a fuel filter 22. An outlet 24 of fuel filter 22 connects to an inlet 26 of a high pressure fuel pump 27. An accumulator 28 collects high pressure fuel from the fuel pump 27.

Accumulator 28 has an outlet 30 connected to a first fuel line 32, which connects to an inlet 34 of a fuel injector 35. Fuel injector 35 has an outlet 36, connected to a second fuel line 38. Additional fuel injectors 35 and fuel lines 38 are connected in a similar manner to form a common fuel rail 44. The last fuel injector 35 in the series has an inlet 34 connected to a fuel line, but its outlet 36 has a plug 48 to terminate the common fuel rail.

Figure 2:
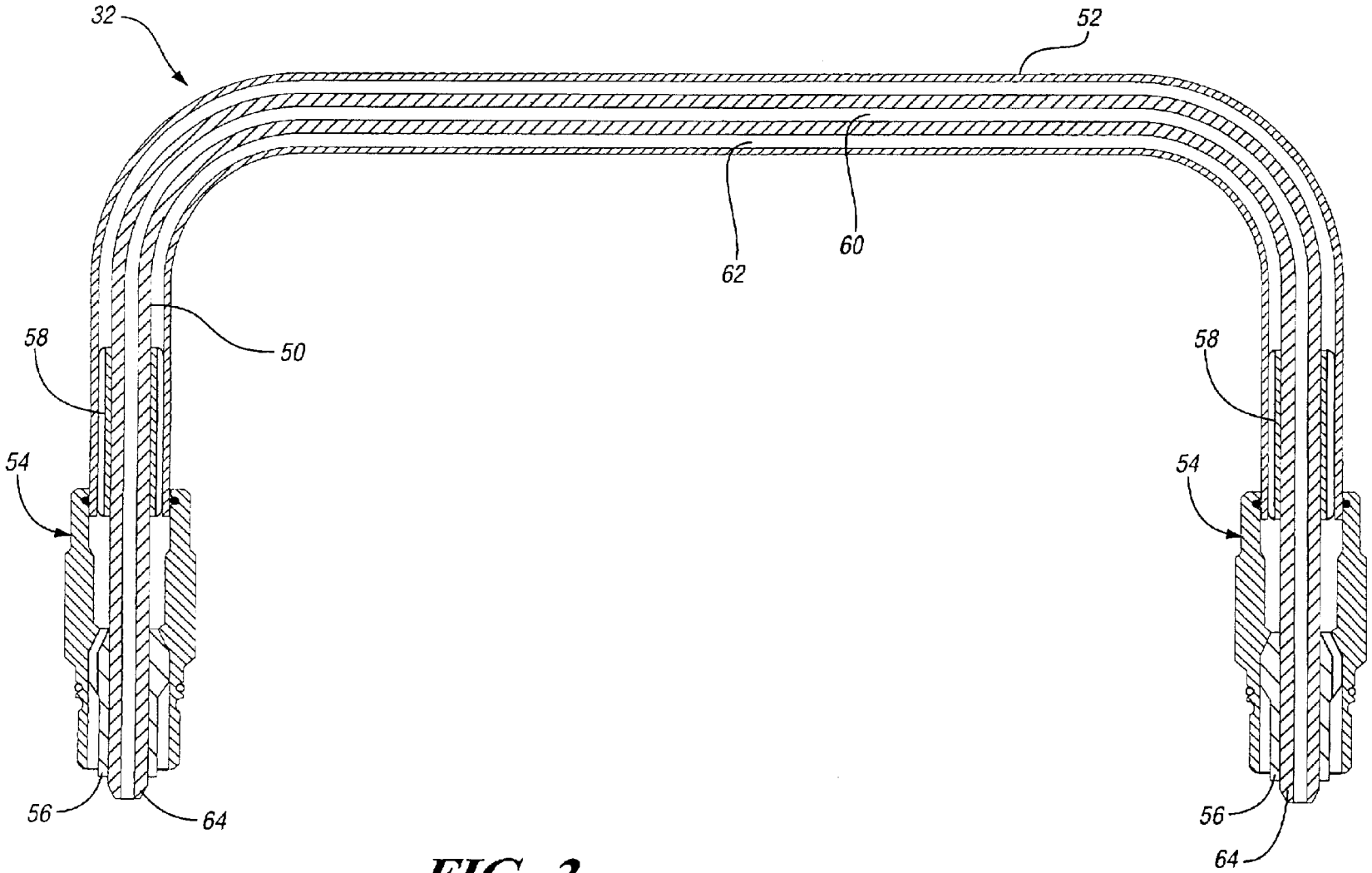
FIG. 2 is an axial cross-sectional view of a double walled fuel line used in the system of FIG. 1.

In accordance with the present invention, fuel line 32 is double walled as shown in FIG. 2. Fuel line 32 includes a high pressure fuel inner tube 50 surrounded by a low pressure fuel outer tube 52 and a coupling 54 mounted on the ends of both tubes. In one embodiment, the tubes 50, 52 and the coupling 54 cooperate with an inner collar 56 and a support sleeve 58. These define a central high pressure fuel passage 60 and a surrounding low pressure return fuel passage 62, both extending to opposite ends 64 of the fuel line 32. The fuel lines 38, which form a common rail connecting a series of fuel injectors 35 preferably have the same construction as the fuel line 32.

Figure 3:
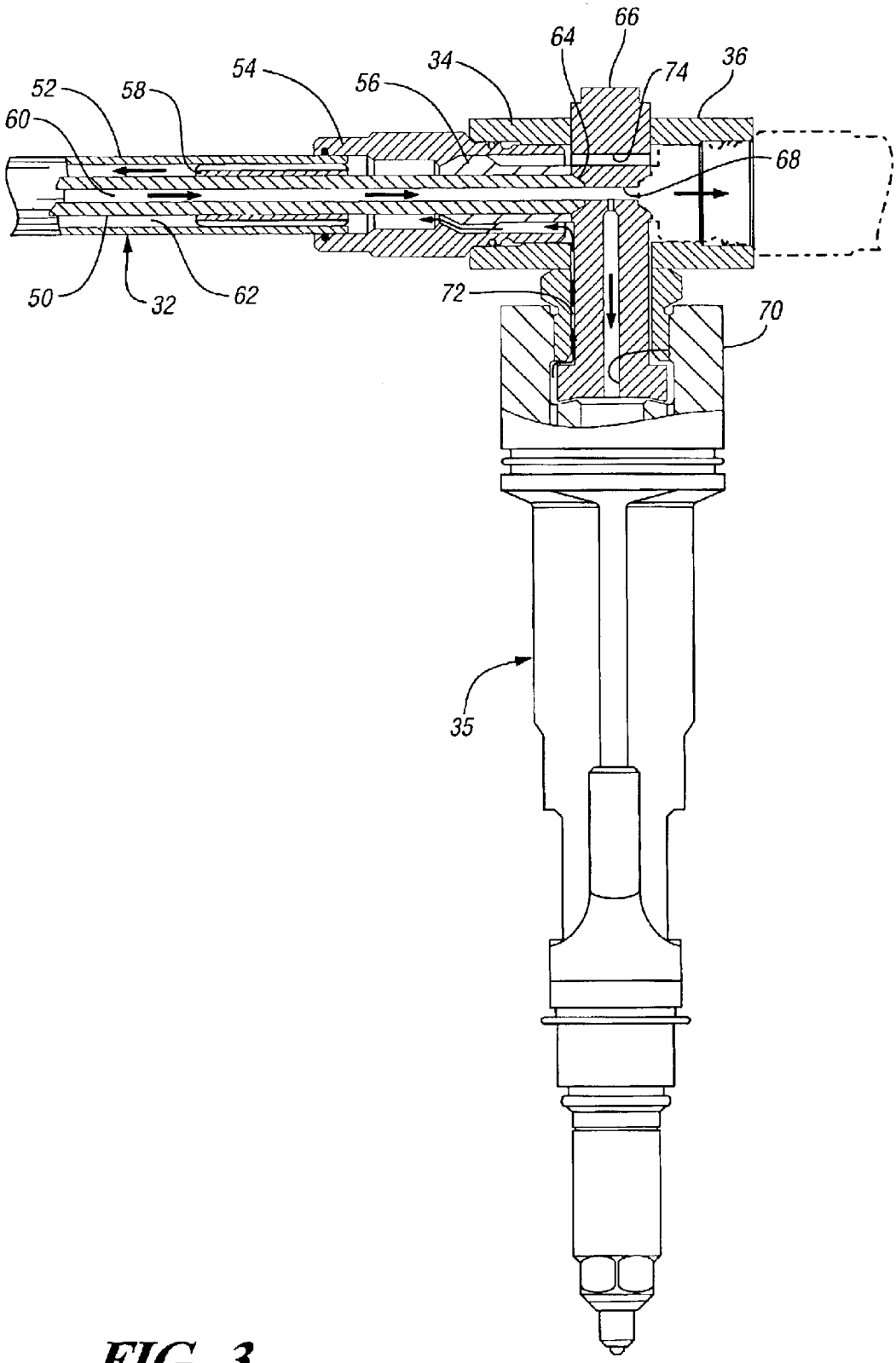
FIG. 3 is a partial cross-sectional view showing the connection of a fuel line with an injector.

FIG. 3 shows in cross-section the connection of a fuel line, 32 or 38 with the inlet 34 of one of the fuel injectors 35. Both the inlet 34 and the outlet 36 define sockets connectable with the coupling 54 of the fuel lines 32, 38. Thus, the high pressure inner tube 50 directly engages an injector member 66 to connect the central high pressure fuel passage 60 with an internal passage 68 which conducts high pressure fuel through the member 66 to an outlet socket 36. The internal passage 68 also forms a T-junction with a high pressure inlet passage 70 of the member 66 to direct high pressure fuel into the body of the injector for injection into an engine cylinder.

The inlet an outlet sockets 34, 36 with fuel lines 32 or 38 also define a low pressure return fuel passage 72 extending from within the injector 35 through the member 66 to the return fuel passage 62 of the fuel line 32. A low pressure fuel bypass passage 74 also extends between the inlet and outlet 34, 36 of each fuel injector 35 to allow low pressure fuel to pass from fuel lines 38 to fuel line 32.

FIG. 1. shows the outlet 30 of the accumulator 28 connected to fuel line 32. The outlet 30 of the accumulator 28 is similar to the outlet 36 of the fuel injector 35, in that it conducts high pressure fuel and receives low pressure fuel in a similar manner. Thus, high pressure fuel is delivered directly into the high pressure fuel passage 60 of the high pressure inner tube 50. Similarly, return fuel is conducted from the return fuel passage 62 of the fuel line 32 into the body of accumulator 28. The low pressure entering the accumulator 28 is returned to the inlet 15 of the fuel pump 16 through internal low pressure fuel passages, not shown, to be recirculated into the system. Alternatively, an external low pressure fuel tube may be provided to carry low pressure fuel from the accumulator 28 to the inlet 15 of the fuel pump 16 or to the fuel tank 12 if desired.

A low pressure fuel sensor 76 monitors return fuel pressure in the low pressure fuel return passages. A control unit 78 connects to the fuel pressure sensor 76 to compare the monitored fuel pressure against a normal fuel pressure map to determine if a fuel leak is present in the system 10.

Alternatively, the low fuel pressure sensor 76 may be located at any convenient location in the low pressure return passage 62 of the first fuel line 32. A high fuel pressure sensor 80 could also be provided to monitor fuel pressure in the high pressure fuel passage 60.

In operation, the low pressure fuel pump 16 draws fuel from the fuel tank 12 through a fuel line 82. The fuel pump 16 sends low pressure fuel through the fuel filter 22 into the high pressure fuel pump 27. High pressure fuel from fuel pump 27 is pumped into the accumulator 28 where pulsations in the fuel are reduced. The high pressure fuel sensor 80 monitors the fuel pressure inside the accumulator. The high pressure fuel is then delivered through the inner tube 50 of the double walled fuel line 32 and series connected fuel lines 38 to the injectors 35. The injectors are controlled by the control unit 78 to conventionally deliver timed charges of atomized fuel to associated engine cylinders, not shown.

A small amount of the high pressure fuel leaks past the injection valves, not shown, of the injectors and is returned through the internal low pressure fuel passage 72 to the low pressure return fuel passages 62 of the associated fuel lines 38, 32.

Low pressure fuel in the return passages 62 is returned to internal passages, not shown, of the accumulator 28 where its pressure is monitored by the low pressure fuel sensor 76. The sensor output is fed to the control unit 78 which determines if a leak is present in the system 10. For this purpose, the indicated pressure of the low pressure return fuel is compared to a map of normal fuel pressures as a function of engine parameters. If a leak in the outer tube 52 occurs, the sensor 76 will detect a below normal fuel pressure, because fuel will escape from the outer tube 52 into its surrounding environment. If a leak in the inner tube 50 occurs, the sensor will detect above normal fuel pressure, because high pressure fuel from the inner tube 50 will escape into the low pressure outer tube 52. Under normal operating conditions the fuel pressure in the low pressure tube 2 will remain within a normal range.

If a leak is detected in the system, the metering valve 15 is closed, stopping the flow of fuel into the system. The metering valve 15 can also be used to reduce the flow of fuel through the system by partially closing.

Figure 4:
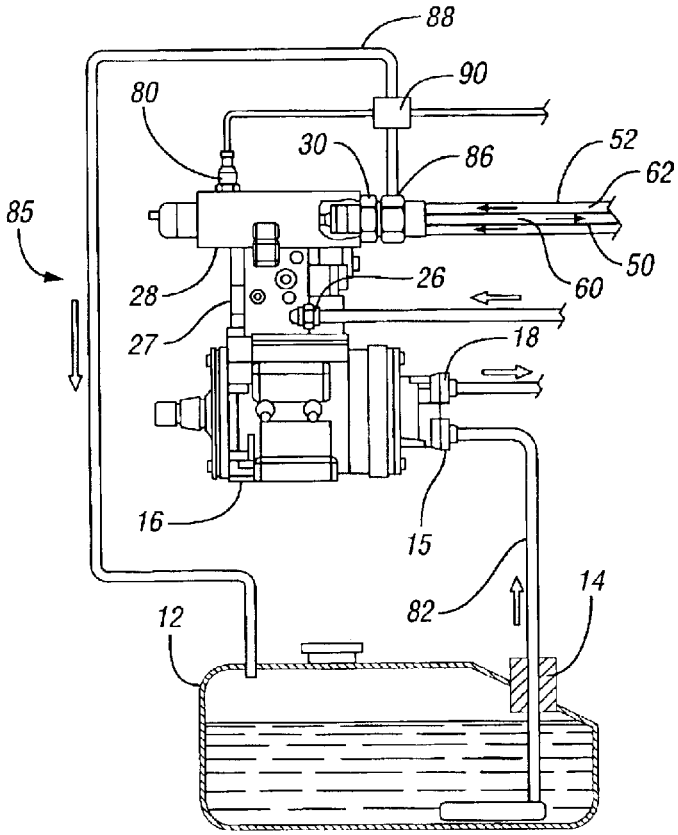
FIG. 4 is a fragmentary view similar to FIG. 1 but showing an external fuel return to the fuel tank.

Referring now to FIG. 4 of the drawings, numeral 85 generally indicates a variation of the system 10 of FIG. 1 in which like numerals indicate like parts. Thus, low pressure fuel pump 16, high pressure fuel pump 27, fuel injectors 35, and fuel line 32 are physically similar and operate in a similar manner to those of system 10.

System 85 includes a T-junction 86 at the outlet port 30 of the accumulator 28. A low pressure fuel return line 88 extends from the T-junction 86 directly to the fuel tank 12. A low pressure fuel sensor 90 is connected to the low pressure fuel return line 88 between the T-junction 86 and the fuel tank 12 to monitor the return fuel pressure in line 88.

In operation, all of the initial steps relating to the delivery of fuel to the injectors are the same as system 10. System 85 differs from system 10 by returning fuel to the fuel tank 12 instead of directly recirculating the fuel back to the low pressure pump through internal passages inside the housing of the pump. The returning fuel exits the double walled fuel line 32 through the T-junction 86 and flows into the low pressure fuel return line 88. The low pressure fuel returning to the fuel tank 12 passes through the fuel pressure sensor 90 which sends a pressure signal to control unit 78 for use in leak detection as before. The low pressure fuel then returns to the fuel tank 12 where it can be recirculated into the system.

Figure 5:
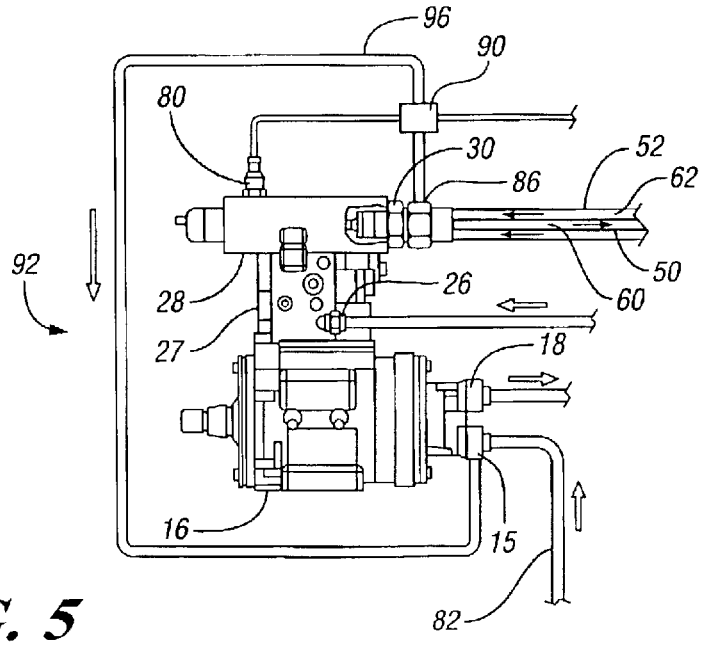
FIG. 5 is a fragmentary view similar to FIG. 4 but showing an external fuel return to the fuel pump inlet.

Referring now to FIG. 5 of the drawings, numeral 92 generally indicates a variation of the system 85 of FIG. 4 using most of the same components as indicated by like numerals.

System 92 differs in that the fuel return line 88 of FIG. 4 is replaced by a low pressure fuel return line 96 extending from the T-junction 86 directly to the metering valve inlet 15 of the low pressure fuel pump 16. A low pressure fuel sensor 90 is connected to the low pressure fuel return line 96 between the T-junction 86 and the metering valve 15 to monitor fuel pressure in line 96.

Operation of the system 92 of FIG. 5 is identical to that of system 85 of FIG. 4 except for the handling of return fuel. The low pressure fuel returning from the fuel injectors 35 is directed by the T-junction 86 into the low pressure fuel return line 96, which carries the fuel to the pump 16 metering valve inlet 15. The returning fuel passes through the fuel pressure sensor 90 which sends a pressure signal to the control unit 78 as before.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A common rail fuel injection system for a diesel engine, said fuel injection system comprising:

a high pressure fuel pump operative to supply high pressure fuel for fuel injection;

a double walled fuel line having an inner high pressure fuel tube surrounded by an outer low pressure return tube, the inner tube defining a high pressure fuel passage connected to receive high pressure fuel from the fuel pump and the outer tube defining a low pressure return fuel passage surrounding the high pressure passage;

a series of fuel injectors communicating with the high pressure passage to receive high pressure fuel for injection and communicating with the low pressure passage to deliver low pressure return fuel for reuse in the system; and a pressure sensor operative to detect changes in fuel pressure in the low pressure passage for use in indicating fuel leaks in either of the high and low pressure fuel tubes.

2. A fuel injection system as in claim 1 wherein the fuel is returned to a fuel tank.

3. A fuel injection system as in claim 1 wherein the fuel is returned to the fuel pump for immediate reuse in the system.

4. A method of detecting fuel leaks in a diesel fuel injection system comprising:

providing a double walled fuel line having a high pressure inner line surrounded by a low pressure outer line;

developing a map of normal fuel pressures in the low pressure line as a function of engine parameters;

monitoring the fuel pressure in the low pressure fuel line; and comparing the monitored fuel pressure values against the normal values of fuel pressure in the low pressure line to determine if a leak is present.

* * * * *